US006803838B2

(12) United States Patent
Hoyland

(10) Patent No.: US 6,803,838 B2
(45) Date of Patent: Oct. 12, 2004

(54) WIDEBAND 180 MICROWAVE PHASE SWITCH

(75) Inventor: Roger Hoyland, Tenerife (ES)

(73) Assignee: Instituto de Astrofisica de Canarias, Santa Cruz de Tenerife (ES)

( * ) Notice: Subject to any disclaimer, the term of this patent is extended or adjusted under 35 U.S.C. 154(b) by 114 days.

(21) Appl. No.: 09/980,993

(22) PCT Filed: Apr. 4, 2001

(86) PCT No.: PCT/ES01/00135

§ 371 (c)(1),
(2), (4) Date: Dec. 4, 2001

(87) PCT Pub. No.: WO01/76003

PCT Pub. Date: Oct. 11, 2001

(65) Prior Publication Data

US 2003/0098759 A1 May 29, 2003

(30) Foreign Application Priority Data

Apr. 4, 2000 (ES) ..... 200000841

(51) Int. Cl.[7] ..... H01P 9/00; H01P 5/12

(52) U.S. Cl. ..... 333/156; 333/115; 333/120; 333/121

(58) Field of Search ..... 333/156, 120, 333/121, 117, 109, 115, 116

(56) References Cited

U.S. PATENT DOCUMENTS

| | | | | |
|---|---|---|---|---|
| 2,639,325 A | | 5/1953 | Lewis | |
| 2,831,168 A | | 4/1958 | Smoll | |
| 3,571,762 A | * | 3/1971 | Smilen | 333/116 |
| 3,593,208 A | | 7/1971 | Smith | |
| 3,678,415 A | | 7/1972 | Takaji | |
| 3,772,616 A | * | 11/1973 | Imoto | 333/128 |
| 4,034,316 A | | 7/1977 | Bex | |
| 4,105,959 A | * | 8/1978 | Stachejko | 333/161 |
| 4,612,520 A | * | 9/1986 | Boire et al. | 333/156 |
| 5,412,354 A | * | 5/1995 | Quan | 333/121 |
| 5,481,231 A | * | 1/1996 | Dydyk et al. | 333/112 |
| 5,680,079 A | * | 10/1997 | Inami et al. | 333/161 |
| 5,917,860 A | * | 6/1999 | Lee | 375/295 |
| 6,104,986 A | * | 8/2000 | Arevalo | 702/120 |

FOREIGN PATENT DOCUMENTS

| | | |
|---|---|---|
| JP | 59-154802 | 12/1980 |
| JP | 59-182601 | 10/1984 |
| JP | 63294103 | 11/1988 |
| JP | 63-294104 | 11/1988 |
| JP | 07-221514 | 8/1995 |

* cited by examiner

*Primary Examiner*—Benny Lee
*Assistant Examiner*—Kimberly E Glenn
(74) *Attorney, Agent, or Firm*—Kirkpatrick & Lockhart LLP; Anthony H. Handal

(57) ABSTRACT

The invention relates to a wideband 180° microwave phase switch structure, consisting of microwave or millimetric wave elements such as waveguides, microstrips, striplines or coaxial cables, which are connected in such a way that they can produce a structure with a 180° phase difference between the two possible low-loss outputs in the band width used, with a high band width, flat phase and balanced amplitude. The structure disclosed in the invention is based on interconnection of two hybrid rings ("magic T") that are embodied according to a given configuration of the different ports of the two rings, thereby providing a unique structure resulting in a practical application device with a 180° phase difference and given properties relative to the length of the waves and the impedances relative to the resulting lines.

36 Claims, 10 Drawing Sheets

WIDEBAND 180 MICROWAVE PHASE SWITCH

This application is for the United States National Filing stage of a PCT application with the Serial No. WO O1/76003 A1 filed on Apr. 4, 2000, which is hereby incorporated by reference.

DESCRIPTION

1. Scope of the Invention

This invention relates to a wideband 180° microwave phase switch structure, its object being the configuration of a 180° switch with optimally balanced phase and amplitude along a high band width with low-loss along all the band, of particular interest in high frequency and low cost applications, as well as in high power applications.

2. Background of the Invention

The interest in 180° phase switch structures in the area of microwave and millimetric waves has increased due to their possible use in communications and stabilisation circuits for scientific measuring among others. With the great increase experienced by digital communications the employment of using only the amplitude switch has passed on to its being used jointly with the phase switch. The latest technological advances have also incorporated the phase switch as stabilisation means of certain types of radiometers.

The phase switch can be performed by means of two DPST (Double-pole-single-throw) switches, FET type (Field Effect Transistor), HEMT (High Electron Mobility Transistor) or PIN diode at each end of two different lengths of a transmission line, in such a way, that it is possible to switch from one to the other. The difference between the switching from one to the other of these line lengths for a given frequency, produces a 180° phase difference in the output signal. This is a very narrow band technique (10% ). A wider band can be obtained if the transmission lines are replaced by circuits with appropriate characteristics.

A more compact design that increases the band width is achieved by means of a Lange type 90° coupler. PIN, HEMT or FET diode switches are placed between the two output ports of the coupler and mass causing an open circuit or short-circuit in both. The resulting reflection through the isolated coupler port can phase-switch by 180° depending on the condition of the switches. This phase switch is of relatively wide band with compact construction, however, it is more prone to unbalance between the two conditions due to the characteristics of the switches. There are more recent designs that use this method with a Balun coupler instead of the Lange coupler (Microwave Journal, December 1999). The resulting configuration is more compact. A design has recently appeared with 4 Baluns and one DPDT (double-pole-double-throw) switch with a very wide band (120% )

Much attention has been paid to the Magic-T or Rat-Race hybrid ring circuit (which is also a 180° coupler) throughout the past 20 years. The ring has been optimised with the purpose of obtaining a high bandwidth (>40%). Various designs have arisen by means of which the band width is raised, using non flat technology instead of the middle wave length line (asymmetric part) of the ring. The resulting ring is more symmetrical and the bandwidth is only limited by the interconnection of the quarter length wave sections. The hybrid ring can be described as a divider or 180° coupler, and is particularly useful in mixer and coupling signal circuits.

Other phase switches use active circuit properties such as FET to obtain phase increases. There are designs by means of which, what is obtained is a continuous phase variation between 0 and 360°. More recently interest has focused on wideband 180° phase switches, flat phase and balanced amplitude in aerospace scientific missions. In order to detect backwall cosmic radiation fluctuations in the microwave margin, radiometers with cryogenic refrigeration have been used, based on HEMT technology. Missions, as for example, MAP (Mocrowave Anisotropy Probe) and the Plank Surveyor, have used the wideband 180° phase switch to stabilise their radiometers. Balanced amplitude and phase are essential for design in order to reduce l/f noise introduced by the HEMT amplifiers. Various thousands of stabilisation factors have been achieved (Meinhold and others, 1999).

DESCRIPTION OF THE INVENTION

The wideband 180° microwave phase switch, is constituted by any microwave or millimetric guide, such as waveguides, microstrips, strip-lines, coaxial cables etc., with a set phase length.

The design is based on the interconnection of two hybrid rings (magic T) that are embodied according to a given configuration of the different ports of the two rings, thereby providing a unique structure resulting in a practical application device with a 180° phase difference characteristic and given properties relative to the length of the waves and the impedances relative to the resulting lines.

Specifically, the 180° phase switch incorporates a microwave or millimetric wave symmetrical circuit with two possible input ports and another two output ports, in such a way that only an input and an output port are simultaneously connected. Both the two input ports and the two output ports are connected by means of a transmission or waveguide line that is equivalent to half the central frequency wavelength of the specific band. Each transmission waveguide line has characteristic root of two impedance, multiplied by the characteristic impedance of the system it belongs to.

Each input port is connected to a different output port by means of a transmission or waveguide line that is equivalent to half the wave length of the specific central band frequency. Each transmission or waveguide line has a characteristic root of two impedance multiplied by the characteristic impedance of the system it belongs to.

The central points of the transmission or waveguide lines between the input and the output ports are interconnected by means of a transmission or waveguide line that is equivalent to half the wave length of the relative central band frequency. Each transmission or waveguide line has a characteristic impedance of the system it belongs to, divided by the root of two.

It relates to a wideband and balanced amplitude and phase structure that can be used as 180° difference phase switch or passive structure. It is appropriate for almost all types of transmission line designs. It can be incorporated in a waveguide using the characteristic guide wave lengths and the actual characteristic impedances of the structure.

DESCRIPTION OF THE DRAWINGS

Complementary to the above indicated description and in order to aid a better understanding of the characteristics of the invention, the present Specification is enclosed, forming integral part of the same, with a set of drawings in which the following are represented with illustrative and non limitative character.

PREFERRED EMBODIMENT OF THE INVENTION

Figure 1A:
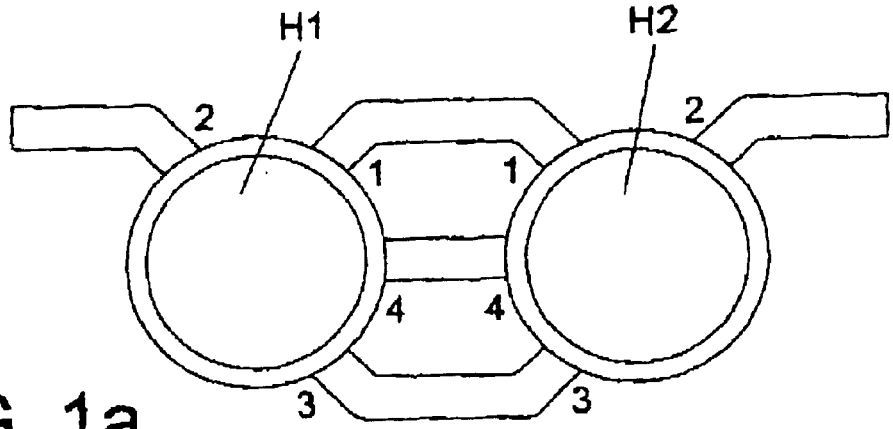
FIGS. 1*a* and 1*b*, show a schematical drawing of the phase structure derivation in which two different forms of connection of the two hybrid rings can be observed.
Figure 1B:
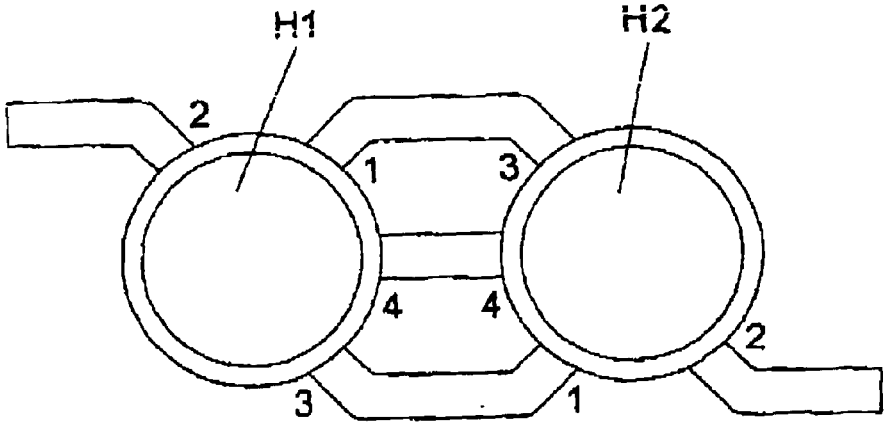

In view of FIG. 1, it can be observed that there are two different forms in which the two hybrid rings (H1) and (H2) can be connected through their ports (1), (3) and (4), due to their asymmetry. The reply of the two configurations, with the signal entering through port (2) of the first hybrid (H1) and exiting through port (2) of the second hybrid (H2) is identical within the band width of the hybrid in amplitude and with 180° phase difference.

Figure 2:
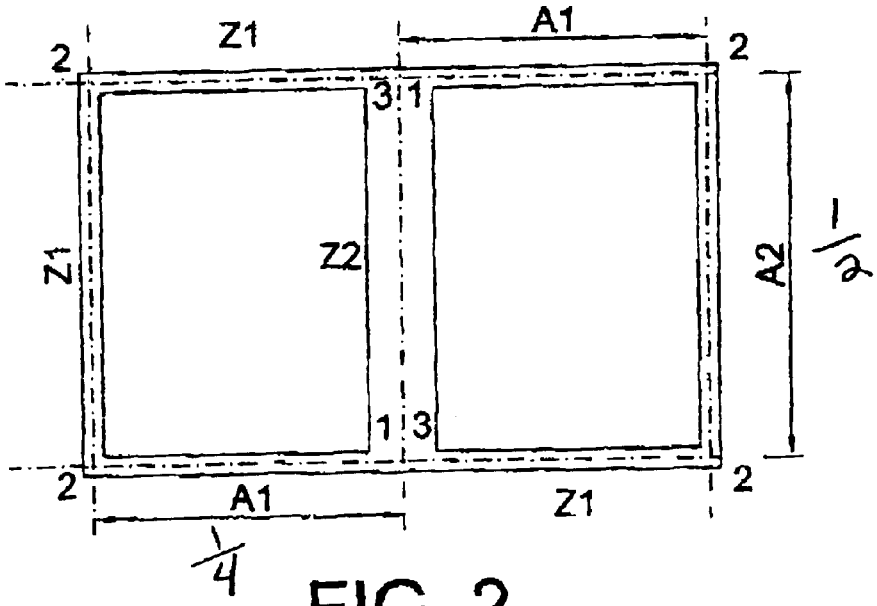
FIG. 2 shows a schematical drawing to which the structures of FIG. 1 can be reduced.

Additionally, the two structures shown in FIG. 1, can be reduced to the structure of FIG. 2. Since there is no input through port (4) of the hybrid (H1), there is no output at port (4) of hybrid (H2), in consequence, port (4) can be eliminated in both. Since there are now two connections of equal length and impedance between ports (1) and (3) in both configurations, it can be reduced to a connection with half the impedance.

FIG. 2 represents two possible positions of port (2) of hybrid (H1) and of port (2) in hybrid (H2). The lengths of each line are: (A1)=¼ and (A2)=½ of the central band frequency length of wave selected in the embodiment of the design. The impedance of each line is now: (Z1) equal to the root of two times (Z0) and (Z2) equal to (Z0) divided by two, where (Z0) is the characteristic impedance of the system in which the structure is used.

This structure has the same response as the two embodied hybrids. In over 40% of the band width there is a phase difference of 180° with a ±1° variation. The return losses are below −15 dB and the difference in amplitude following the two signal paths is below 0.1 dB.

An improvement is obtained if the structure in a microwave simulator is optimised. It can be achieved, that the phase response is maintained flat at 50% of the band (180°±1°) with similar amplitudes (<−0.02 dB) and return loss (<−23 dB).

The described structure has various advantages over others relative to 180° phase switches, in addition to the very flat phase response and a very low loss at 55% of the band width. In the first place, it is a complete flat structure, easily carried out in MIC (Microwave Integrated Circuit) or MMIC (Monolithic Microwave Circuit). It is a wide structure considering the frequency band, which signifies low tolerances compared with other designs, as for example, the Lange coupler, which is an advantage with large volumes of production and high frequency design.

The design is compatible with various wide band components still in use. The clearest is the 180° phase switch. The two possible positions of port (2) in hybrid (H2), shall each be connected to a diode switch, HEMT or FET, whilst the input signal is connected to one of the hybrid ports (H1). This configuration can be reversed in such a way that the switches remain associated to the hybrid (H1) and one single output signal to hybrid (H2). The switches with outputs connected to the output or input signals are alternately activated and deactivated. The output or input is alternately connected to each side of the structure. If the switches are of the Shunt type, (short circuit) a ¼ wave length section of the central frequency shall be added at the input and the output of each switch. This does not significantly reduce the characteristics since the structure can be optimised again in order to eliminate the effect (which is to reduce the band width) of the extra length of the line.

Due to the fact that diodes HEMT or transistors FET are alternatively activated and deactivated, it is possible to compensate any unbalance that could be produced in the actual switches that might affect the amplitude as occurs in other designs. This is achieved by means of the variation of the bias voltage.

The structure is symmetrical and the switches can be coupled to the input and output ports causing both the phase switching and the switching between two signals (if the two inputs are connected to different input ports). Also (with one single input and output port), as there are four possible phase switching states and only two possible phase states, it is possible to combine the states two by two adding the replies. In this way, in circuits that are similar to those described in FIGS. 5 and 10, it is possible to eliminate l/f noise of the actual phase switches.

Various practical application cases of the invention are herewith presented. Each one of these applications is either an autonomous element used in a microwave laboratory or an internal component of an applications equipment. In reality, some of the applications described are used as part of another application, but each one of them is valid in the form presented. The various applications are already known, however, the 180° phase switch structure adds a new dimension that may be the increase in bandwidth, a high degree of insulation, balance, etc.

The most direct use of the 180° phase switch structure is a two-phase modulator (which is the same as the phase switch), that is used in a large amount of circuits among which are the following:

Radiometric/interferometric stabilizer.

Phase modulator in communications

Radio frequency laboratory testing equipment

The phase modulator is very common in millimetric wave industry. Up to very recently, it has consisted of a narrow band unbalanced amplitude element, which signifies a disadvantage on almost all applications.

Figure 3:
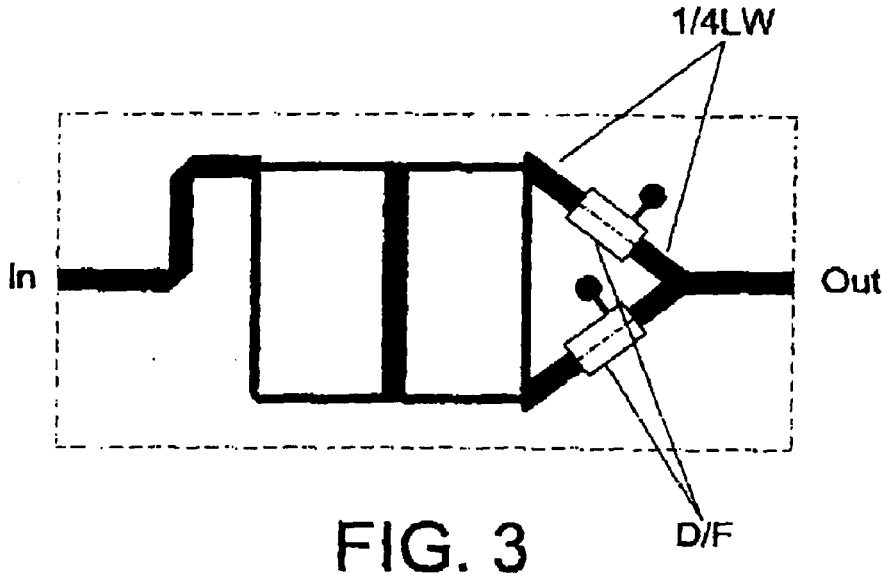
FIGS. 3 to 12 show different practical application cases of the phase switch.
Figure 4:
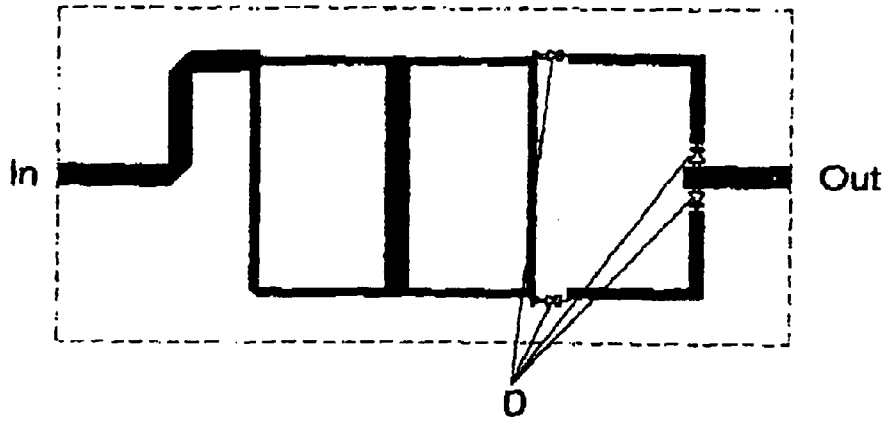

In FIGS. 3 and 4 are represented illustrative two-phase modulators with two different constructive solutions, the first of which is based on shunt type of switches, constituted by two diodes/FET (D/F) considering ¼ wave length lines (¼ LW) and the second only in diodes (D) connected in series in order to offer in both cases, a phase variation between 0° and 180°.

The 180° phase switch structure can be seen to be connected to two HEMT diodes or FET transistors at ports (2) according to the invention. The outputs of the two switches are connected to the output of the two-phase modulator (out). The input (in) is connected to port (2) of the opposite side of the 180° phase switch structure.

Generally, two classes of switches exist: in parallel and in series. FIG. 3 shows the parallel arrangement in which two quarter wave length lines are connected to the input and to the output of each switch to establish an open circuit at port (2) of the phase switch structure and at the output joint when the switch is in short circuit. FIG. 4 shows the series arrangement of the switch in which it can be seen that four diodes with two line lengths between them, were used. With a small modification of the 180° phase switch structure the connection line length can be eliminated, the circuit can then be constituted by two diodes such as in the derivation arrangement. With the series switches, a higher wave width is obtained than with parallel switches.

In microstrip, this circuit is carried out in flat technology and can be reproduced in MIC or MMIC. The circuit is simple and wide (over half the wave length) with a relatively low tolerance at the line widths in comparison with the Lange coupler. It is very appropriate for the construction in the 10–100 Ghz frequency range with the current available technology.

Figure 5:
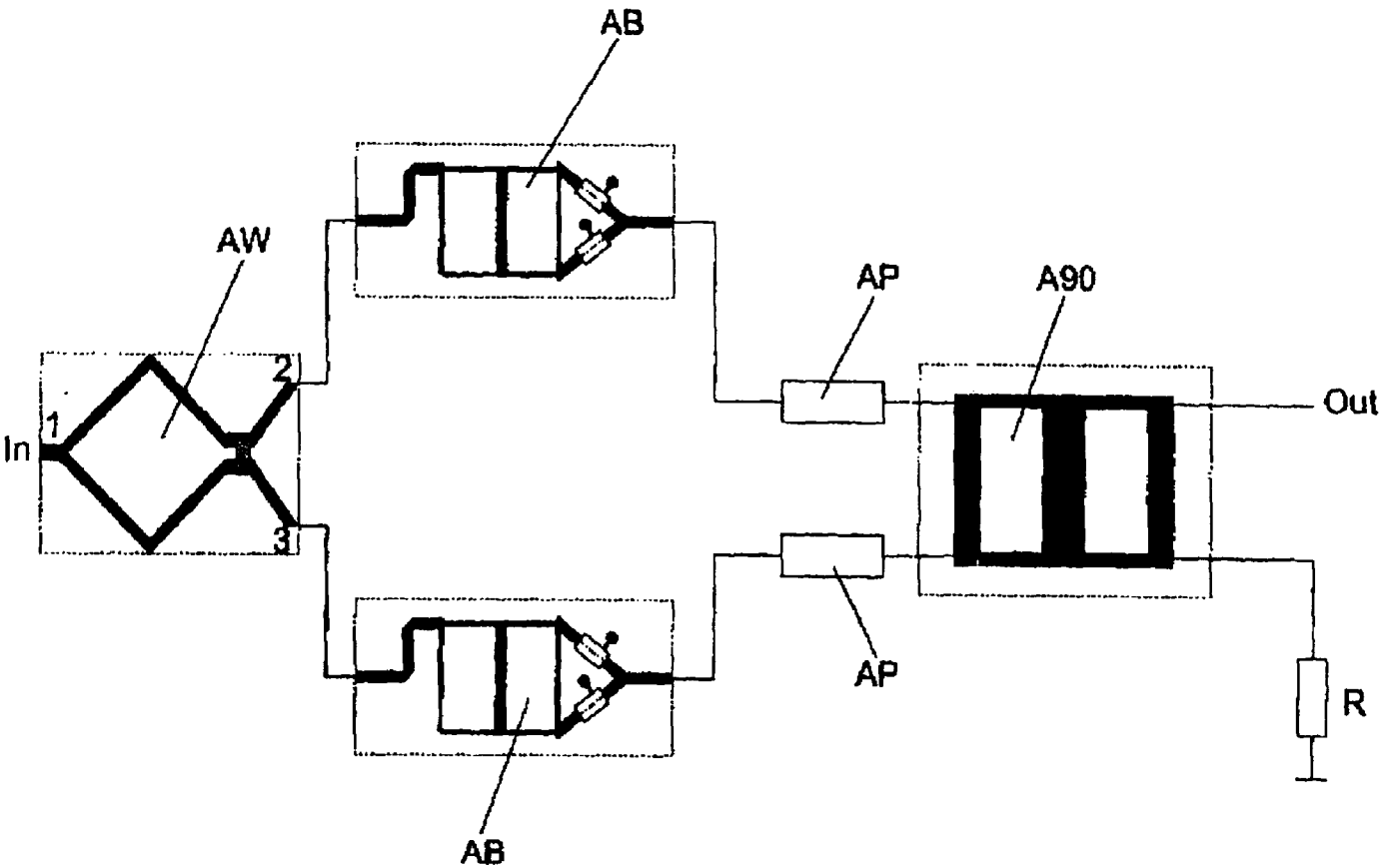

A vector modulator appears in FIG. 5 formed by two two-phase modulators. The most recent advances relative to communications have signified that both the phase modulation and the amplitude modulation can be simultaneously carried out by giving an improved signal relative to the band width and the stability, very necessary in the current over saturated user bands. Circuits are being designed to test QAUM (quadrature amplitude modulation) and QPSK (quadrature phase shift keying) equipments as regards phase and amplitude characteristics. These circuits are being designed to be wide band and must generally be characterised and corrected due to unbalanced elements. The 180° phase switch structure is balanced and is also potentially wide band.

In FIG. 5, a configuration is shown for a QAM/QPSK modulator. The input (in) signal is divided in two by means of a Wilkinson coupler (AW) and each output passes through a two-phase modulator (AB) of the previously described type. The signals then pass through programmable attenuators (AP) and their output feeds a 90° coupler. One side of the latter coupler goes to a 50 ohms termination (R), the other goes to the output (out). The circuit is extremely well balanced up to the 90° coupler, the circuit balance depending consequently on this coupler. An even more balanced circuit is that of FIG. 12.

By means of the joint switching of the two-phase modulator and the control of QAM/QSK attenuators simultaneous modulations and phase amplitudes can be obtained.

Figure 6:
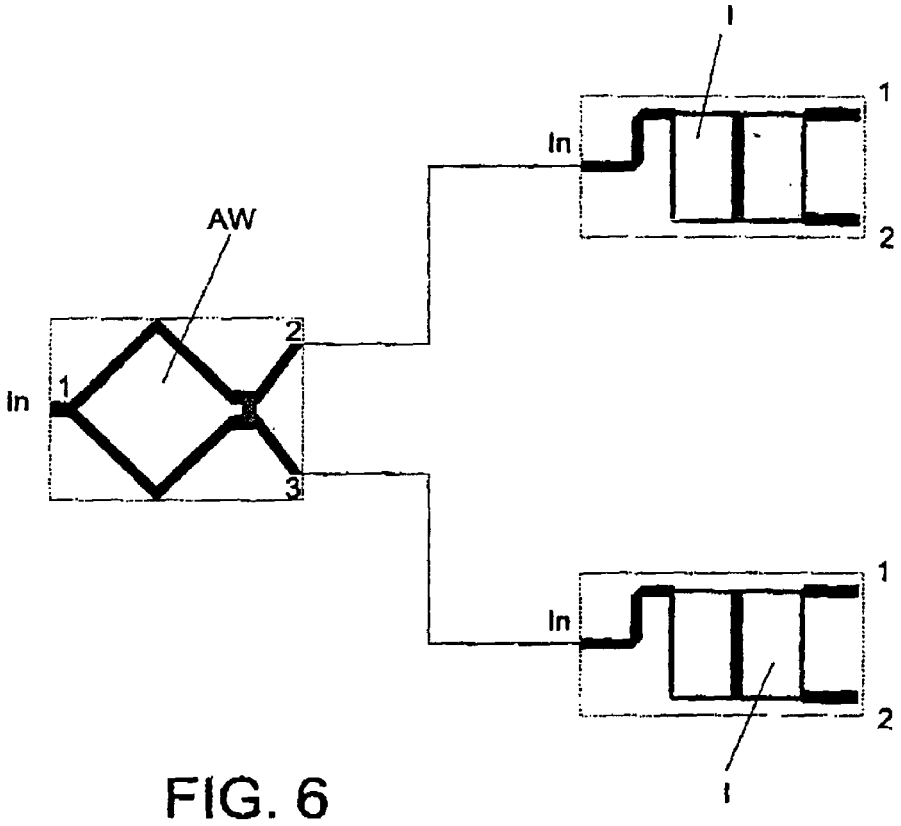

Though the 180° phase voltage phase divider that appears in FIG. 6 is a simple application of the invention, it is a useful part in laboratory equipments. No active components exist, so that the design can be embodied in relatively simple flat technology with very low costs even for high frequency modulus. The phase divider of the Figure can admit a flexible design that allows a partition of 0°/0°/, 0°/180° depending on whether ports (1) or (2) of the phase change (I) structure are connected to the outputs whilst the others are left in open circuits. Since the other involved element is a Wilkinson (AW) coupler, connected to the inputs of the phase change structures (in) to divide the input signal, a wideband and unequal division possibility exists.

Figure 7:
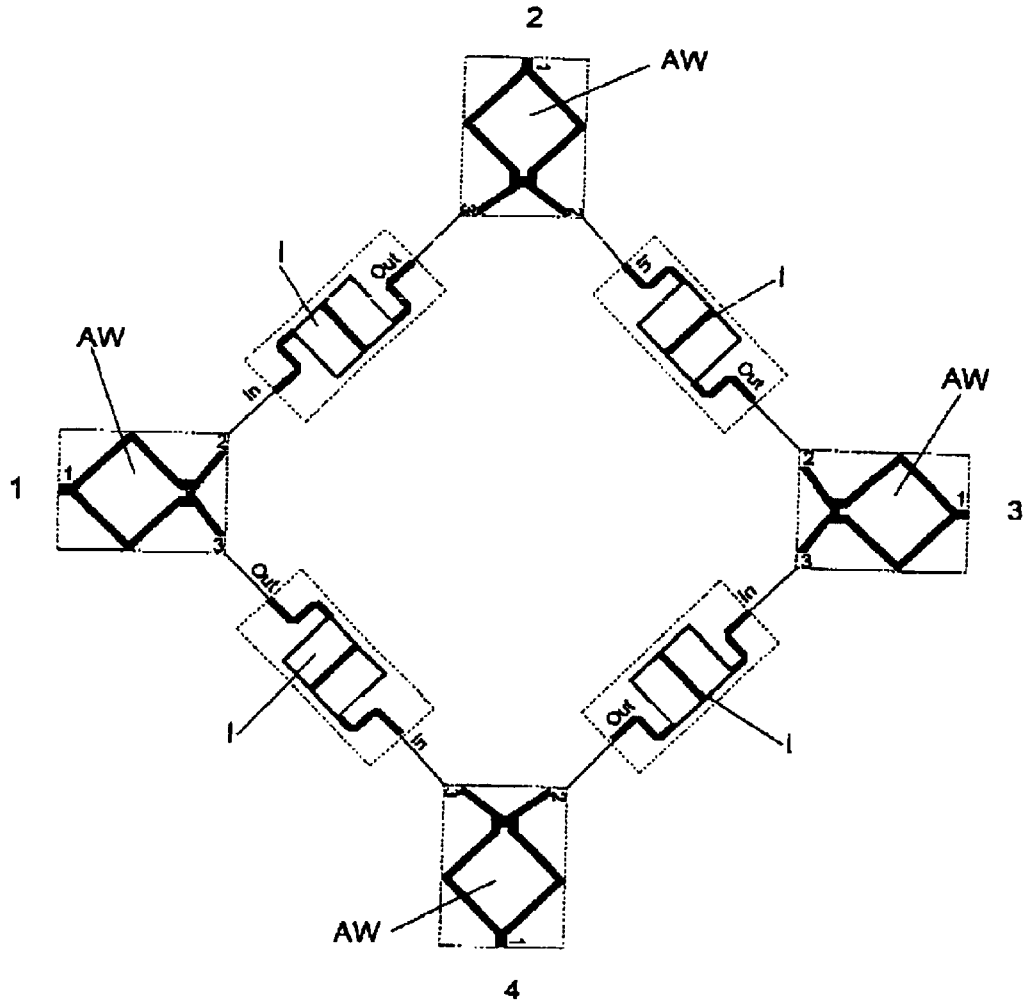

One of the most useful passive components intended for use in microwave and millimetric frequencies is a 0°/180° or 90°/0° coupler. This circuit constitutes the perfect form of combining equally two microwave signals in two outputs. The limitation of such elements is the unbalance, both in the phase division and in the amplitude and as a consequence, the relatively narrow band and the low insulation of the third port. FIG. 7 shows an arrangement in which the configuration of the 180° phase switch structure (I) has been implemented in its 180° or 0° passive forms. Four of these components have been placed between four Wilkinson (AW) couplers. Three of the passive phase switch structures are in 0° form and the other in 180° form. By studying the Figure it can be observed that the circuit performs the same function as a hybrid coupler. A signal in port (1) shall be divided in equal parts between ports (2) and (4) whilst it shall be isolated from port (3). Following the same argument, a signal that enters port (3) shall be equally divided between ports (2) and (4) whilst it shall be isolated from port (1). The hybrid is wideband and the insulation that can be obtained in port (3) is of approximately 60 dB with only a 3 dB signal amplitude loss. This hybrid can be manufactured in flat technology, its construction being relatively easy.

Figure 8:
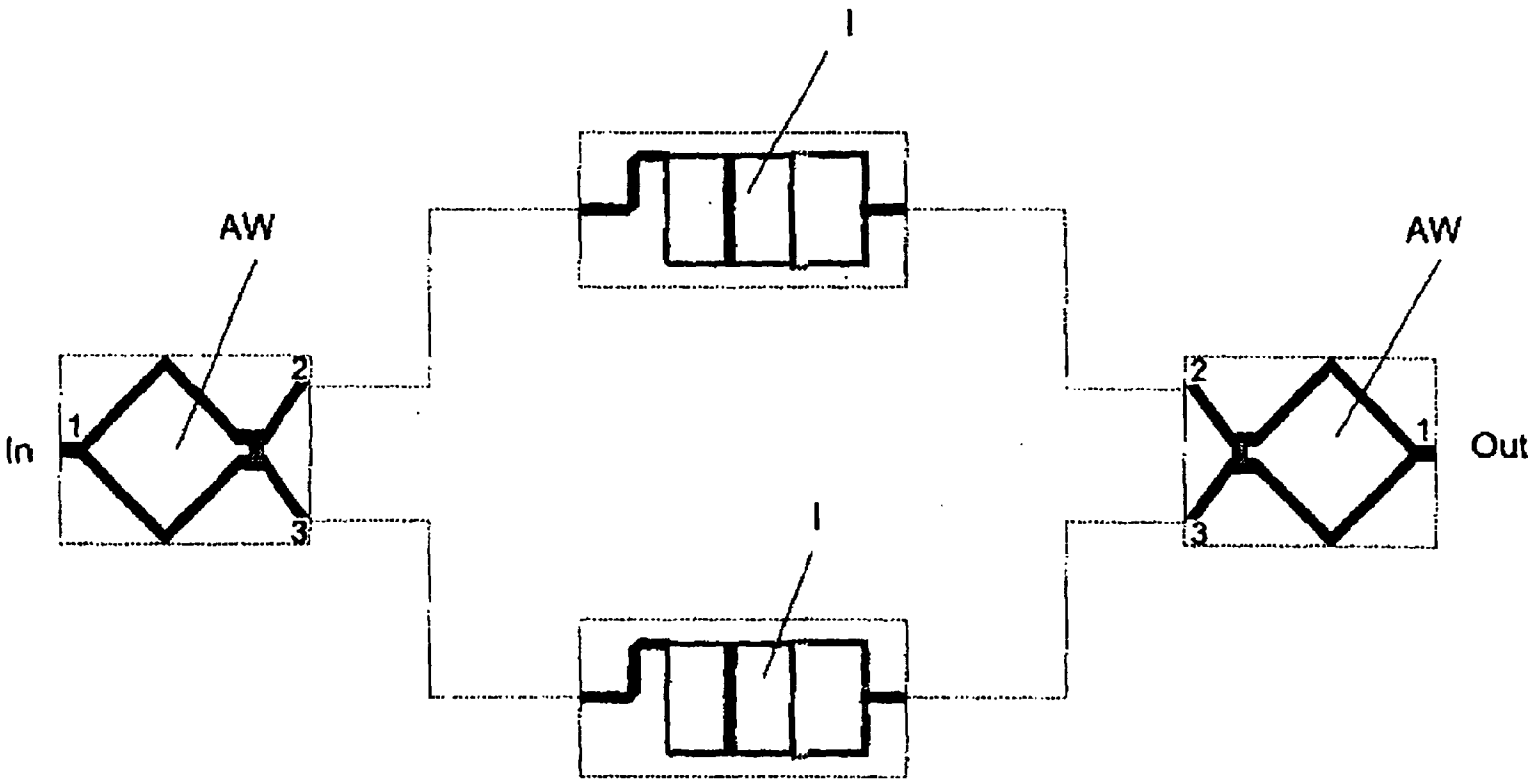

A component that is very often used in communication circuits is the SPST switch (single-pole-single-throw). One of its requirements is a high insulation so that the signal transmitted does not enter the receptor chain. FIG. 8 shows a switch with these characteristics formed by Wilkinson (AW) couplers and two two-phase modulators. The two-phase modulators can operate with a low consumption-feeding source since they do not need to be provided with a high insulation switch. However, the symmetry of this design offers great insulation at the circuit output. It is of the non-reflective type which means that the input (in) signal shall always see a 50 ohm impedance independent from the condition of the switch if the output (out) ends with a 50 ohm impedance.

Figure 9:
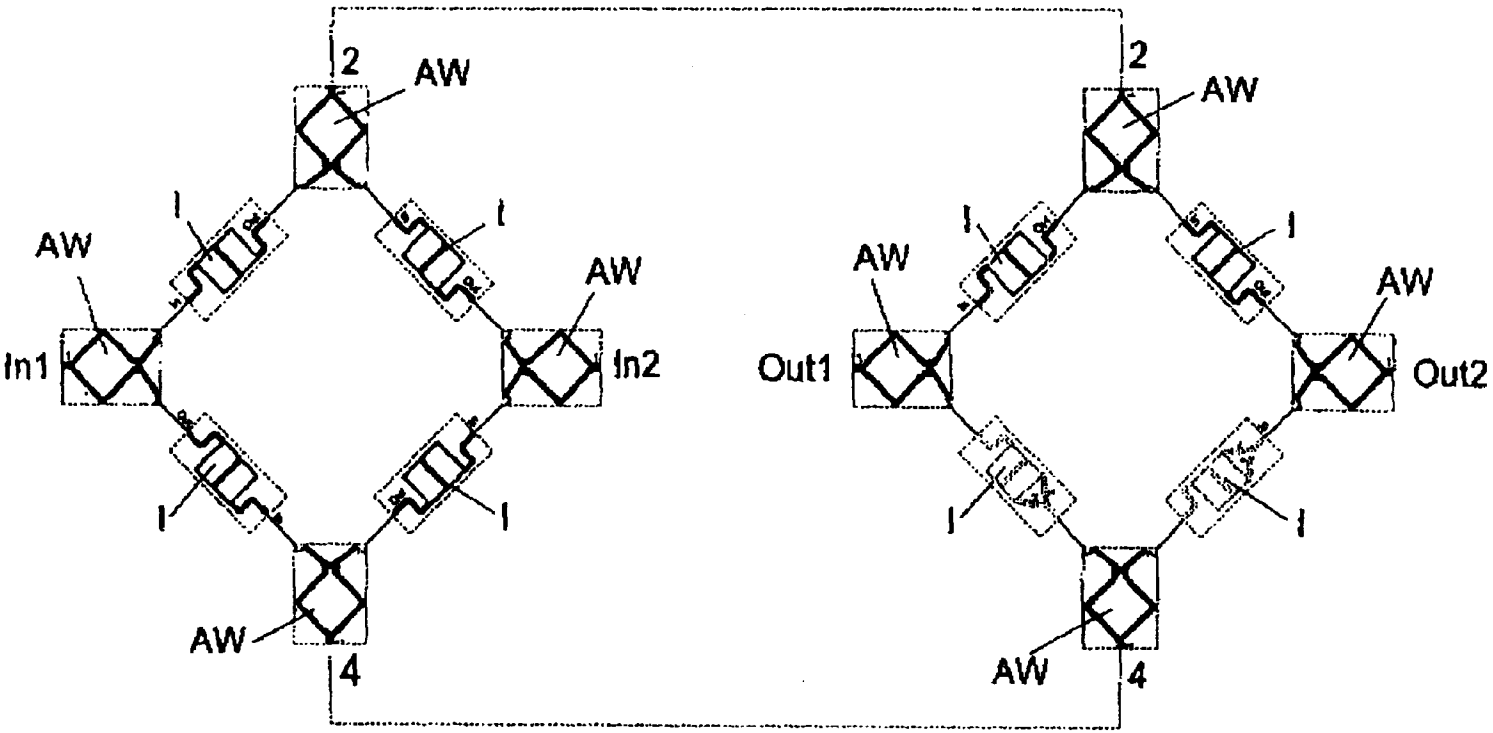
Figure 10:
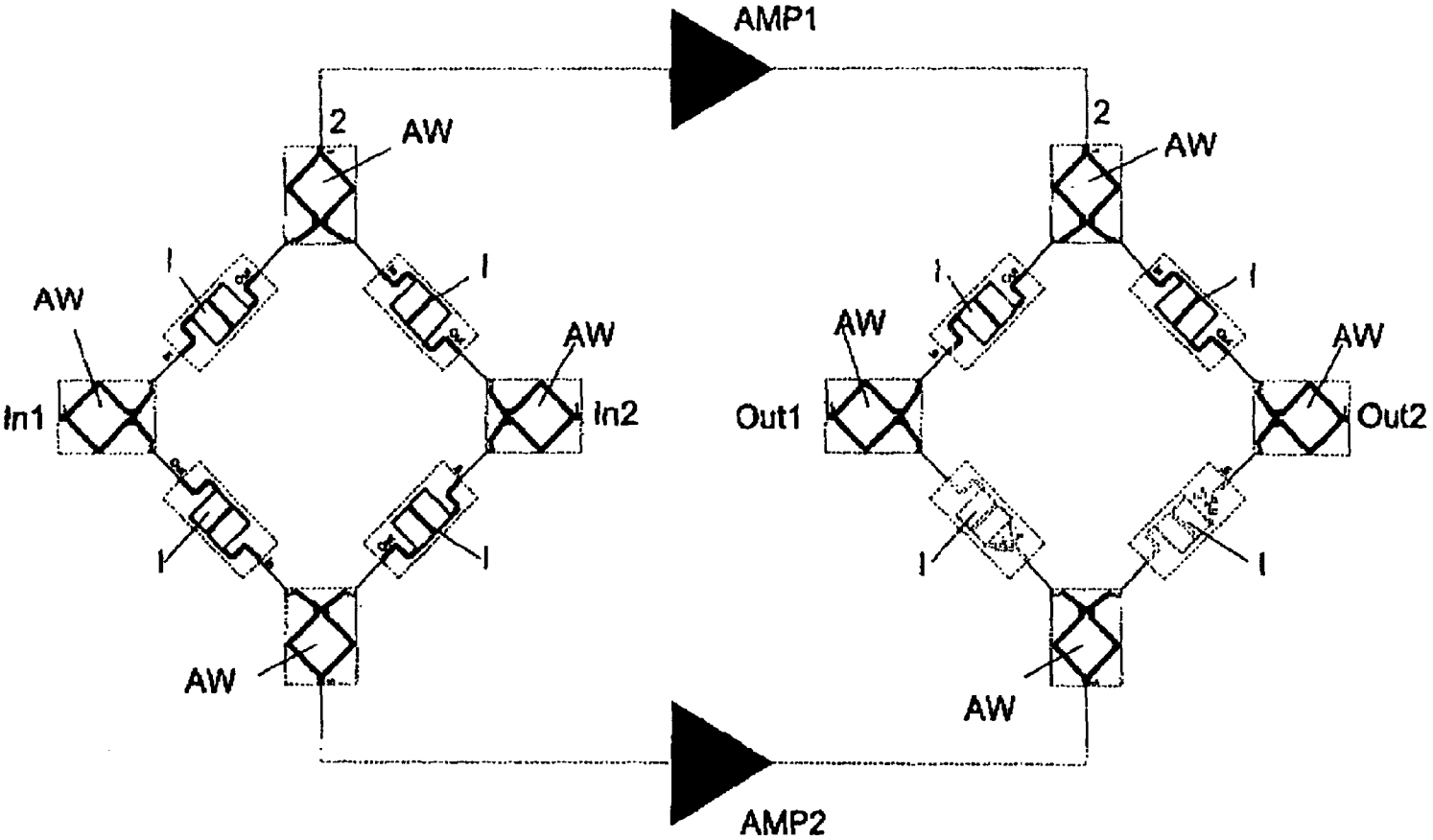

With the high insulation hybrid design of FIG. 7 it is possible to make a DPDT switch (double-pole-double-throw) of high insulation or stabilisation network. Two such hybrides are connected through their ports (2) and (4). Ports (1) and (3) are converted into inputs (in) and outputs (out). Two of the 180° phase switch structures (I) are replaced by two-phase modulators of the second hybrid. By means of the alternate switching of these between positions 0° and 180°, the outputs are interchanged. The two-phase switch positions are not unique. Various configurations offer the same result. This design provides a high degree of insulation between all the input and output ports with a 6 dB signal loss. FIG. 9 shows the arrangement of this switch and FIG. 10 shows another option for the obtention of a balanced correlator circuit. In this, the signals that exit from the output of the first hybrid are passed through two amplifiers (AMP1 and AMP2). The signals are then decorrelated in the second hybrid. The hybrids area is very well balanced, thereby achieving the maximum insulation and the l/f type gain fluctuations, due to the fact that the amplifiers are very similar in each one of the output ports and in this manner, by differentiating them, the l/f noise can be practically eliminated.

Figure 11:
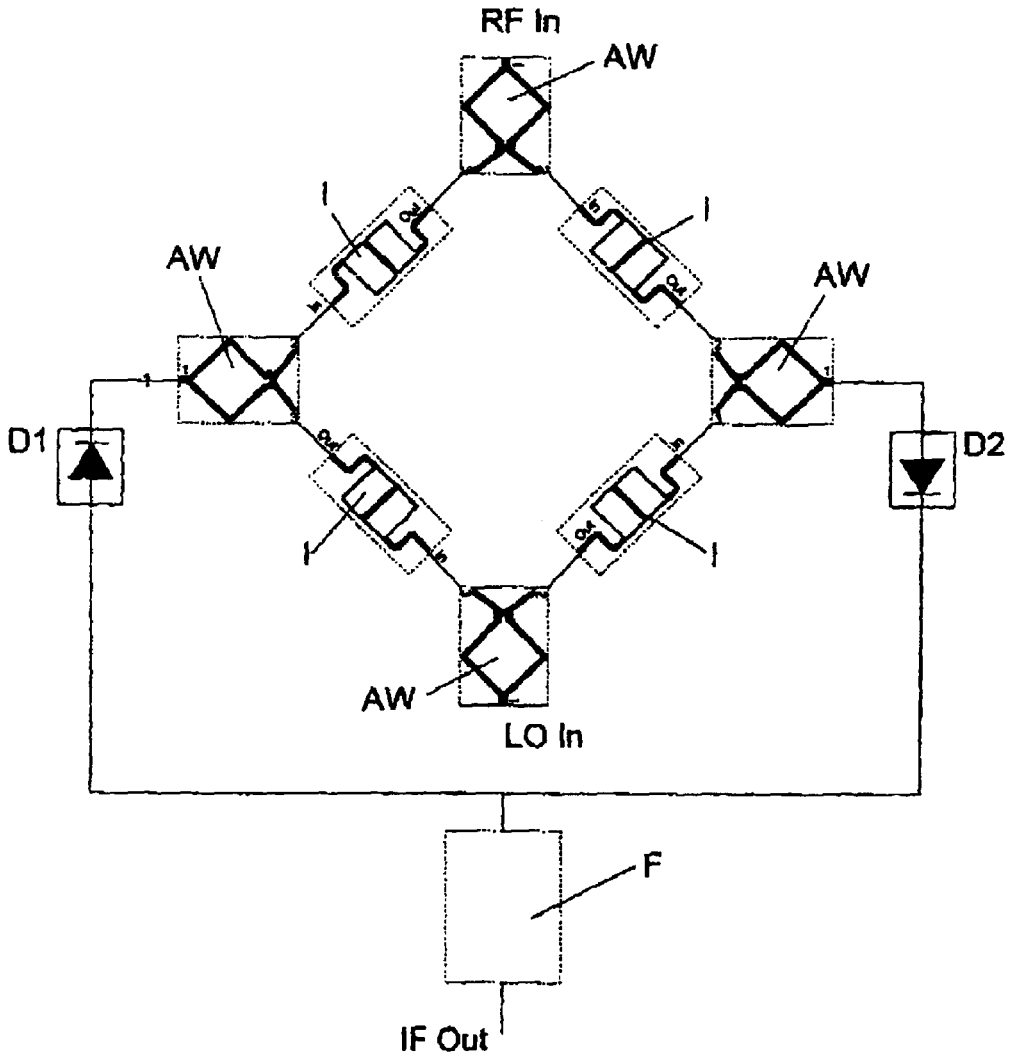

Another common component in the microwave circuits is the mixer. Many types of mixers exist, depending on the circuit to be designed. The hybrid of FIG. 7 can be used as balanced mixer (single-balanced mixer). The arrangement of FIG. 11 is used, in which the RF signal enters through port (RFIn) and the signal LO through port (LOIn), thereby providing a great insulation between the two. The outputs associated to ports (2) and (4) are led to two diodes (D1) (D2) in anti-parallel arrangement by means of balanced circuits. Finally, the outputs of the diodes are combined and later filtered through filter (F). The filter output is the output of the device (IFOut) The circuit has the possibility of being wide band with only the theoretical 3 dB loss through the hybrid circuit. A possible improvement consists in the use of two Wilkinson couplers (AW) from the four that couple in a ratio of 10:1 in the hybrid output ports (2) and (4). Signal RF can be led to the side of less loss, whilst the LO, attenuated in 10 dB, through the couplers should be increased in the same amount. The advantage of all this is a reduced degree of noise in all the system (if the RFIn input signal is small in comparison with LOIn) and less conversion losses. If the phase structures are replaced by two-phase modulators, the output can be phase-switched for a greater stability in components placed after the output.

Figure 12:
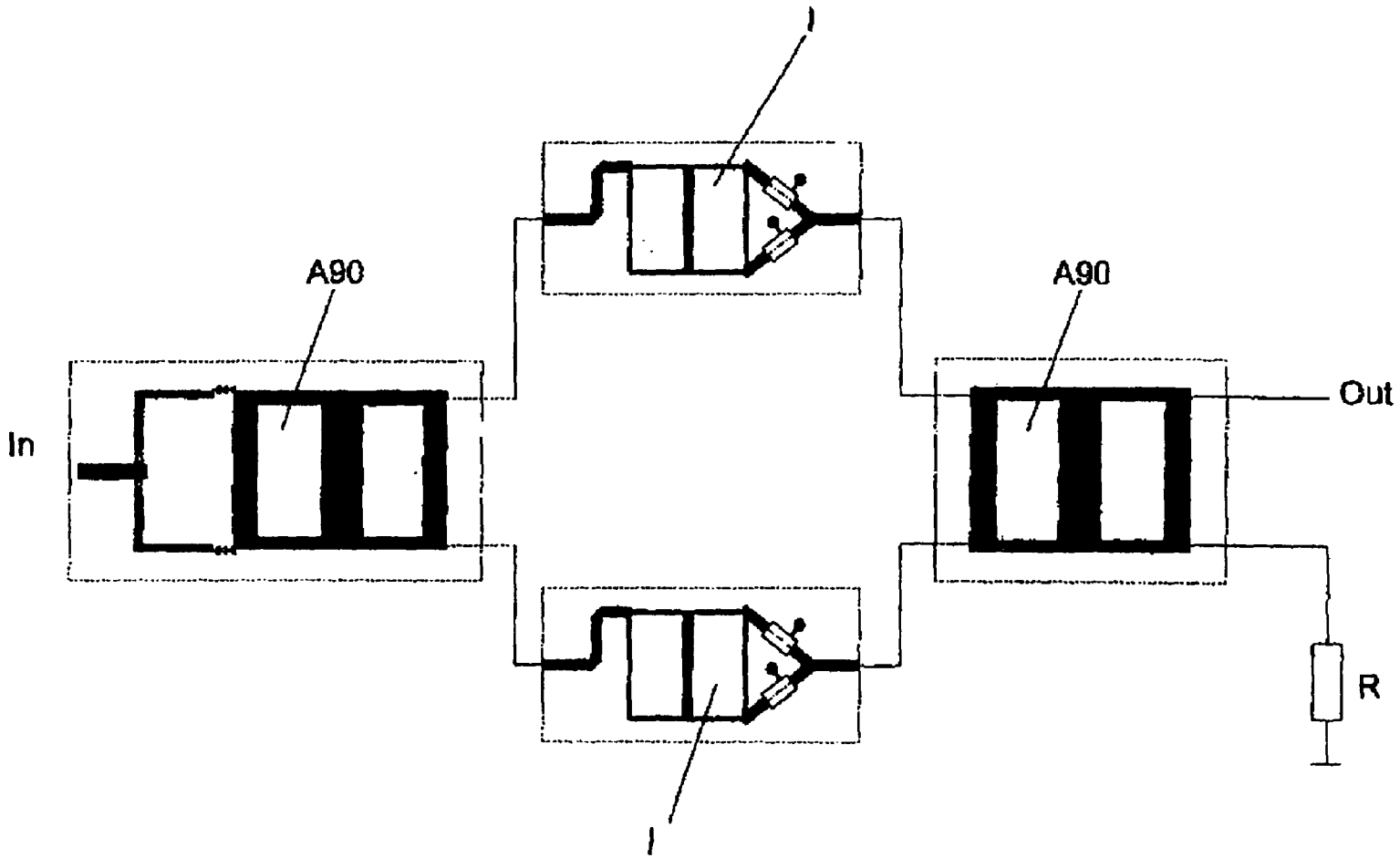

Finally, there exists an interesting use of the two-phase modulators in a four-phase modulator. FIG. 12 shows the configuration that permits the four-phase switching. It is similar to the QAM/QPSK modulator except that the input coupler is also a 90° coupler (A90), very similar to the output coupler. The output is led to this coupler by means of a switching system similar to the two-phase switch. With the appropriate co-ordination of the switches, it is possible to obtain changes of 0°, 90°, 180° and 270°. Each phase has the same amplitude and with an attenuator that is programmable to the output, this circuit can perform certain types of QAM or QPSK switching. The object of this circuit is to be well balanced since the effects of unbalance of the 90° input coupler are corrected within seconds.

A modification of the mixer in FIG. 11 can be the use of a modulator of FIG. 12 instead of the two-phase modulators. It is possible to produce a very wide band mixer of the image rejection mixer type. This type of mixer has the capability of removing the useless band from the double-side-band signal that inputs through the port (RFIn). Since the modulator can switch, it is also possible to switch between the top band and the bottom band of the local oscillator frequency (LO).

What is claimed is:

1. A high frequency wideband 180° phase switch circuit for insertion into a external circuit having an input signal port, an output signal port, and a characteristic impedance $Z_0$, the circuit comprising:

a first input port;

a second input port;

a first output port;

a second output port;

a first waveguide coupled between the first input port and the second input port;

a second waveguide coupled between the first output port and the second output port;

a third waveguide coupled between the first input port and the first output port;

a fourth waveguide coupled between the second input port and the second output port; and a fifth waveguide coupled between central points of the third waveguide and the fourth waveguide;

where:

at a center frequency of a pre-determined frequency band, each of the waveguides is a half wavelength waveguide with respect to the center frequency;

the first, second, third, and fourth waveguides have a first impedance approximately given by $\sqrt{2}Z_0$; and the fifth waveguide has a second impedance approximately given by $$\frac{Z_0}{\sqrt{2}}.$$

2. The circuit of claim 1, where at least one of the first and second impedances is a simulation optimized impedance selected to obtain a 180° phase difference between the first and second output ports for a given input signal applied to one of the first and second input ports, while improving transmission loss and return loss in the pre-determined frequency band.

3. The circuit of claim 2, further comprising at least one of a FET switch, HEMT switch, and PIN diode switch connected in series with at least one of the input and output ports.

4. The circuit of claim 3, where:

each switch connected to an input port connects to the input signal port; and each switch connected to an output port connects to the output signal port, the switches providing switching of the input signal port between the first and second input ports, and the output signal port between the first and second output ports.

5. The circuit of claim 4, where at least one of the first and second impedances is a simulation optimized impedance selected to obtain a 180° phase difference between the first and second output ports for a given input signal applied to one of the first and second input ports, while improving transmission loss and return loss in the pre-determined frequency band.

6. The circuit of claim 4, where at least one of the waveguides is a simulation length-optimized waveguide selected to obtain a 180° phase difference between the first and second output ports for a given input signal applied to one of the first and second input ports, while improving transmission loss and return loss in the pre-determined frequency band.

7. The circuit of claim 3, where each switch connected to an input port connects to the input signal port through a half wavelength, at the center frequency, waveguide; and each switch connected to an output port connects to the output signal port through a half wavelength, at the center frequency, waveguide, the switches providing switching of the input signal port between the input ports and output signal port between the output ports.

8. The circuit of claim 7, where at least one of the first and second impedances is a simulation optimized impedance selected to obtain a 180° phase difference between the first and second output ports for a given input signal applied to one of the first and second input ports, while improving transmission loss and return loss in the pre-determined frequency band.

9. The circuit of claim 7, where at least one of the waveguides is a simulation length-optimized waveguide selected to obtain a 180° phase difference between the first and second output ports for a given input signal applied to one of the first and second input ports, while improving transmission loss and return loss in the pre-determined frequency band.

10. The circuit of claim 3, where:

each switch connected to an input port connects to the input signal port through a waveguide;

each switch connected to an output port connects to the output signal port through a waveguide; and further comprising a series terminating switch, comprising at least one of a FET, HEMT, and a PIN diode switch, connected to each waveguide;

the switches providing switching of the input signal port between the input ports and the output signal port between the output ports.

11. The circuit of claim 10, where at least one of the first and second impedances is a simulation optimized impedance selected to obtain a 180° phase difference between the first and second output ports for a given input signal applied to one of the first and second input ports, while improving transmission loss and return loss in the pre-determined frequency band.

12. The circuit of claim 10, where at least one of the waveguides is a simulation length-optimized waveguide selected to obtain a 180° phase difference between the first and second output polls for a given input signal applied to one of the first and second input ports, while improving transmission loss and return loss in the pre-determined frequency band.

13. The circuit of claim 3, where at least one of the first and second impedances is a simulation optimized impedance selected to obtain a 180° phase difference between the first and second output ports for a given input signal applied to one of the first and second input ports, while improving transmission loss and return loss in the pre-determined frequency band.

14. The circuit of claim 2, further comprising:

first parallel switches, each terminating first quarter wavelength, at the center frequency, waveguide connected to at least one of the input ports; and second parallel switches, each terminating second quarter wavelength, at the center frequency, waveguides connected to at least one of the output ports, the first and second switches comprising at least one of a FET, HEMT, and PIN diode.

15. The circuit of claim 14, where:

each first switch connects to the input signal port through third quarter wavelength, at the center frequency, waveguides;

each second switch connects to the output signal port through fourth quarter wavelength, at the center frequency, waveguides;

the first switches providing switching of the input signal port between the input ports and the second switches providing switching of the output ports to the output signal port.

16. The circuit of claim 15, where at least one of the first and second impedances is a simulation optimized impedance selected to obtain a 180° phase difference between the first and second output ports for a given input signal applied to one of the first and second input ports, while improving transmission loss and return loss in the pre-determined frequency band.

17. The circuit of claim 15, where at least one of the waveguides is a simulation length-optimized waveguide selected to obtain a 180° phase difference between the first and second output ports for a given input signal applied to one of the first and second input ports, while improving transmission loss and return loss in the pre-determined frequency band.

18. The circuit of claim 14, where at least one of the first and second impedances is a simulation optimized impedance selected to obtain a 180° phase difference between the first and second output ports for a given input signal applied to one of the first and second input ports, while improving transmission loss and return loss in the pre-determined frequency band.

19. The circuit of claim 14, where at least one of the waveguides is a simulation length-optimized waveguide selected to obtain a 180° phase difference between the first and second output ports for a given input signal applied to one of the first and second input ports, while improving transmission loss and return loss in the pre-determined frequency band.

20. The circuit of claim 1, further comprising at least one of a FET switch, HEMT switch, and PIN diode switch connected in series with at least one of the input and output ports.

21. The circuit of claim 19, where:

each switch connected to an input port connects to the input signal port; and each switch connected to an output port connects to the output signal port, the switches providing switching of the input signal port between the first and second input ports, and the output signal port between the first and second output ports.

22. The circuit of claim 21, where at least one of the first and second impedances is a simulation optimized impedance selected to obtain a 180° phase difference between the first and second output ports for a given input signal applied to one of the first and second input ports, while improving transmission loss and return loss in the pre-determined frequency band.

23. The circuit of claim 21, where at least one of the waveguides is a simulation length-optimized waveguide selected to obtain a 180° phase difference between the first and second output ports for a given input signal applied to one of the first and second input ports, while improving transmission loss and return loss in the pre-determined frequency band.

24. The circuit of claim 19, where:

each switch connected to an input port connects to the input signal port through a half wavelength, at the center frequency, waveguide; and each switch connected to an output port connects to the output signal port through a half wavelength, at the center frequency, waveguide, the switches providing switching of the input signal port between the input ports and output signal port between the output ports.

25. The circuit of claim 24, where at least one of the first and second impedances is a simulation optimized impedance selected to obtain a 180° phase difference between the first and second output ports for a given input signal applied to one of the first and second input ports, while improving transmission loss and return loss in the pre-determined frequency band.

26. The circuit of claim 24, where at least one of the waveguides is a simulation length-optimized waveguide selected to obtain a 180° phase difference between the first and second output ports for a given input signal applied to one of the first and second input ports, while improving transmission loss and return loss in the pre-determined frequency band.

27. The circuit of claim 19, where:

each switch connected to an input port connects to the input signal port through a waveguide;

each switch connected to an output port connects to the output signal port through a waveguide; and further comprising a series terminating switch, comprising at least one of a FET, HEMT, and a PIN diode switch, connected to each waveguide;

the switches providing switching of the input signal port between the input ports and the output signal port between the output ports.

28. The circuit of claim 27, where at least one of the first and second impedances is a simulation optimized impedance selected to obtain a 180° phase difference between the first and second output ports for a given input signal applied to one of the first and second input ports, while improving transmission loss and return loss in the pre-determined frequency band.

29. The circuit of claim 27, where at least one of the waveguides is a simulation length-optimized waveguide selected to obtain a 180° phase difference between the first and second output ports for a given input signal applied to one of the first and second input ports, while improving transmission loss and return loss in the pre-determined frequency band.

30. The circuit of claim 19, where at least one of the first and second impedances is a simulation optimized impedance selected to obtain a 180° phase difference between the first and second output ports for a given input signal applied to one of the first and second input ports, while improving transmission loss and return loss in the pre-determined frequency band.

31. The circuit of claim 1, further comprising:

first parallel switches, each terminating first quarter wavelength, at the center frequency, waveguides connected to at least one of the input ports; and second parallel switches, each terminating second quarter wavelength, at the center frequency, waveguides connected to at least one of the output ports, the first and second switches comprising at least one of a FET, HEMT and PIN diode.

32. The circuit of claim 31, where:

each first switch connects to the input signal port through third quarter wavelength, at the center frequency, waveguides;

each second switch connects to the output signal port through fourth quarter wavelength, at the center frequency, waveguides;

the first switches providing switching of the input signal port between the input ports and the second switches providing switching of the output ports to the output signal port.

33. The circuit of claim 32, where at least one of the first and second impedances is a simulation optimized impedance selected to obtain a 180° phase difference between the first and second output ports for a given input signal applied to one of the first and second input ports, while improving transmission loss and return loss in the pre-determined frequency band.

34. The circuit of claim 32, where at least one of the waveguides is a simulation length-optimized waveguide selected to obtain a 180° phase difference between the first and second output ports for a given input signal applied to one of the first and second input ports, while improving transmission loss and return loss in the pre-determined frequency band.

35. The circuit of claim 31, where at least one of the first and second impedances is a simulation optimized impedance selected to obtain a 180° phase difference between the first and second output ports for a given input signal applied to one of the first and second input ports, while improving transmission loss and return loss in the pre-determined frequency band.

36. The circuit of claim 31, where at least one of the waveguides is a simulation length-optimized waveguide selected to obtain a 180° phase difference between the first and second output ports for a given input signal applied to one of the first and second input ports, while improving transmission loss and return loss in the pre-determined frequency band.

* * * * *